US008919880B2

(12) United States Patent
Bellingar et al.

(10) Patent No.: US 8,919,880 B2
(45) Date of Patent: Dec. 30, 2014

(54) FLEXIBLE SEATING SURFACE

(71) Applicant: Haworth, Inc., Holland, MI (US)

(72) Inventors: Teresa A. Bellingar, Holland, MI (US); Larry A. Wilkerson, Comstock Park, MI (US); Peter J. Beyer, Hamilton, MI (US)

(73) Assignee: Haworth, Inc., Holland, MI (US)

( * ) Notice: Subject to any disclaimer, the term of this patent is extended or adjusted under 35 U.S.C. 154(b) by 49 days.

(21) Appl. No.: 13/851,343

(22) Filed: Mar. 27, 2013

(65) Prior Publication Data

US 2013/0257125 A1 Oct. 3, 2013

Related U.S. Application Data

(60) Provisional application No. 61/615,962, filed on Mar. 27, 2012.

(51) Int. Cl.

| | |
|---|---|
| ***A47C 3/00*** | (2006.01) |
| ***A47C 7/50*** | (2006.01) |
| ***A47C 7/22*** | (2006.01) |

(52) U.S. Cl.

CPC .... *A47C 7/50* (2013.01); *A47C 7/22* (2013.01)
USPC ..... 297/284.1; 297/452.15

(58) Field of Classification Search

CPC ..... B60N 2/66; A47C 7/282; A47C 7/466; A47C 7/465; A47C 7/46; A47C 5/12
USPC ..... 297/284.1, 284.2, 284.4, 452.63, 297/452.56, 452.15

See application file for complete search history.

(56) References Cited

U.S. PATENT DOCUMENTS

| | | | | | |
|---|---|---|---|---|---|
| 4,418,958 | A * | 12/1983 | Watkin | 297/452.15 |
| 4,502,731 | A * | 3/1985 | Snider | 297/452.54 |
| 4,660,887 | A * | 4/1987 | Fleming et al. | 297/448.2 |
| 4,892,356 | A * | 1/1990 | Pittman et al. | 297/452.15 |
| 5,123,702 | A * | 6/1992 | Caruso | 297/440.21 |
| 5,154,485 | A * | 10/1992 | Fleishman | 297/446.1 |
| 5,314,240 | A * | 5/1994 | Ishi et al. | 297/452.15 |
| 6,409,268 | B1 * | 6/2002 | Cvek | 297/452.29 |
| 6,688,687 | B2 * | 2/2004 | Chu | 297/284.4 |
| 7,032,971 | B2 * | 4/2006 | Williams | 297/284.4 |
| 8,590,978 | B2 * | 11/2013 | Jaranson et al. | 297/452.15 |
| 8,678,505 | B2 * | 3/2014 | Kanda et al. | 297/452.15 |
| 2004/0160100 | A1 * | 8/2004 | Forkel et al. | 297/284.4 |

* cited by examiner

*Primary Examiner* — Jose V Chen

(74) *Attorney, Agent, or Firm* — Warner Norcross & Judd LLP

(57) ABSTRACT

A seat has a first ischial region, a second ischial region, a tailbone region and a thigh transitional region, each having at least one slot. Each slot generally opens outward, away from a center of the seat. Each slot may have an elongated central portion and two distal portions extending from the central portion. The central portion and distal portions may be substantially linear and may have a specific configuration relative to each other to provide desired support characteristics. The slots may allow flexing and cantilevering of portions of the seat to dynamically contour the seat based on the weight of the user. Multiple grooves may be included at the front of the seat to facilitate curling of the front of the seat.

17 Claims, 5 Drawing Sheets

FLEXIBLE SEATING SURFACE

BACKGROUND OF THE INVENTION

The present invention relates to seating surfaces, and more particularly to flexible seating surfaces.

Seating surfaces have experienced many advances over the years. For example, the materials used in the seating surface, the manufacturing methods used to create the seating surface, and the visual appearance of the seating surface have all been improved over time.

Another area of advancement in seating surfaces involves the contouring of the seat. Much time and effort have been spent designing contoured seats that closely match the shape of a user's body. Although some prior art surfaces are closely contoured to a user's body, some of these surfaces still create high pressure areas in certain zones. This results in discomfort for the user, and possibly injury over an extended period of sitting.

Some prior art seating surface configurations include slotted configurations. However, in many of these slotted configurations, the slots appear to be randomly spaced across the entire seating surface. Some of these configurations therefore fail to recognize or address the specific high pressure areas present in certain zones of the seat.

Further, many prior art seating surfaces are designed for a narrow range of user weights. Many of these surfaces may work well for users within a narrow range of weights, but are less than desirable for users having a weight outside of the intended narrow weight range.

Although much advancement has been made in the field of seating surfaces, there remains room for improvement in this technology area.

SUMMARY OF THE INVENTION

The present invention provides a seat with slots specifically designed and positioned to provide desired support characteristics and relieve pressure for a user while sitting on the seat. The slots may allow cantilevering of various seat portions, which contours the seat based on a user's weight. This configuration may have beneficial support characteristics similar to a foam seat.

In one embodiment, the seat includes a first ischial region, a second ischial region, a tailbone region and a thigh transitional region. Each of these regions includes at least one slot for providing desired support characteristics. A longitudinal axis extends from a front of the seat to a rear of the seat and generally divides the seat into two halves. A center of the seat is located between the first ischial region, the second ischial region, the tailbone region and the thigh transitional region. A plurality of first ischial slots are defined within the seat in the first ischial region and generally open outwardly, away from the center of the seat. A plurality of second ischial slots are defined within the seat in the second ischial region and generally open outwardly, away from the center of the seat. A tailbone slot is defined within the seat in the tailbone region and generally opens outwardly, away from the center of the seat. A thigh transitional slot is defined within the seat in the thigh transitional region and generally opens outwardly, away from the center of the seat.

In another embodiment, at least a portion of each of the first ischial slots and the second ischial slots may extend substantially parallel to the longitudinal axis. At least a portion of each of the tailbone slot and the thigh transitional slot may extend at an angle relative to the longitudinal axis.

In another embodiment, each slot may include an elongated central portion, a first distal portion and a second distal portion. An end portion may be defined adjacent each distal portion. The central and distal portions may be substantially linear, and the distal portions may extend from each corresponding central portion at an angle. The angles between each distal portion and the corresponding central portion may be substantially equal.

In another embodiment, the slots in the seat may have a specific configuration with respect to each other to provide desired support characteristics. The tailbone slot central portion and the thigh transitional slot central portion may be substantially parallel to each other and may be substantially perpendicular to the longitudinal axis. The first ischial slot central portions and the second ischial slot central portions may be substantially parallel to each other and may be substantially parallel to the longitudinal axis. The first ischial slot first distal portions, the second ischial slot second distal portions, the tailbone slot first distal portion and the thigh transitional slot first distal portion may be substantially parallel to each other. The first ischial slot second distal portions, the second ischial slot first distal portions, the tailbone slot second distal portion and the thigh transitional slot second distal portion may be substantially parallel to each other.

In another embodiment, the slots in the seat may have a further specific configuration with respect to the longitudinal axis to provide desired support characteristics. The longitudinal axis may separate the first ischial slots and the second ischial slots. The longitudinal axis may intersect the tailbone slot and thigh transitional slot, and may bisect the central portion of each of these slots.

In another embodiment, the slots may generally be curved or open outward, away from a center of the seat. The outwardly opening configuration may allow portions of the seat positioned adjacent and outward of each slot to deflect downward relative to the seat surface and outward relative to the center of the seat.

In another embodiment, the seat may include a plurality of grooves positioned at a front of the seat to facilitate curling of the front of the seat. The grooves may be substantially linear and may extend substantially parallel to each other and substantially perpendicular to the longitudinal axis.

These and other objects, advantages, and features of the invention will be more fully understood and appreciated by reference to the description of the current embodiments and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and may be practiced or may be carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DETAILED DESCRIPTION OF THE CURRENT EMBODIMENT

I. Overview

Figure 1:
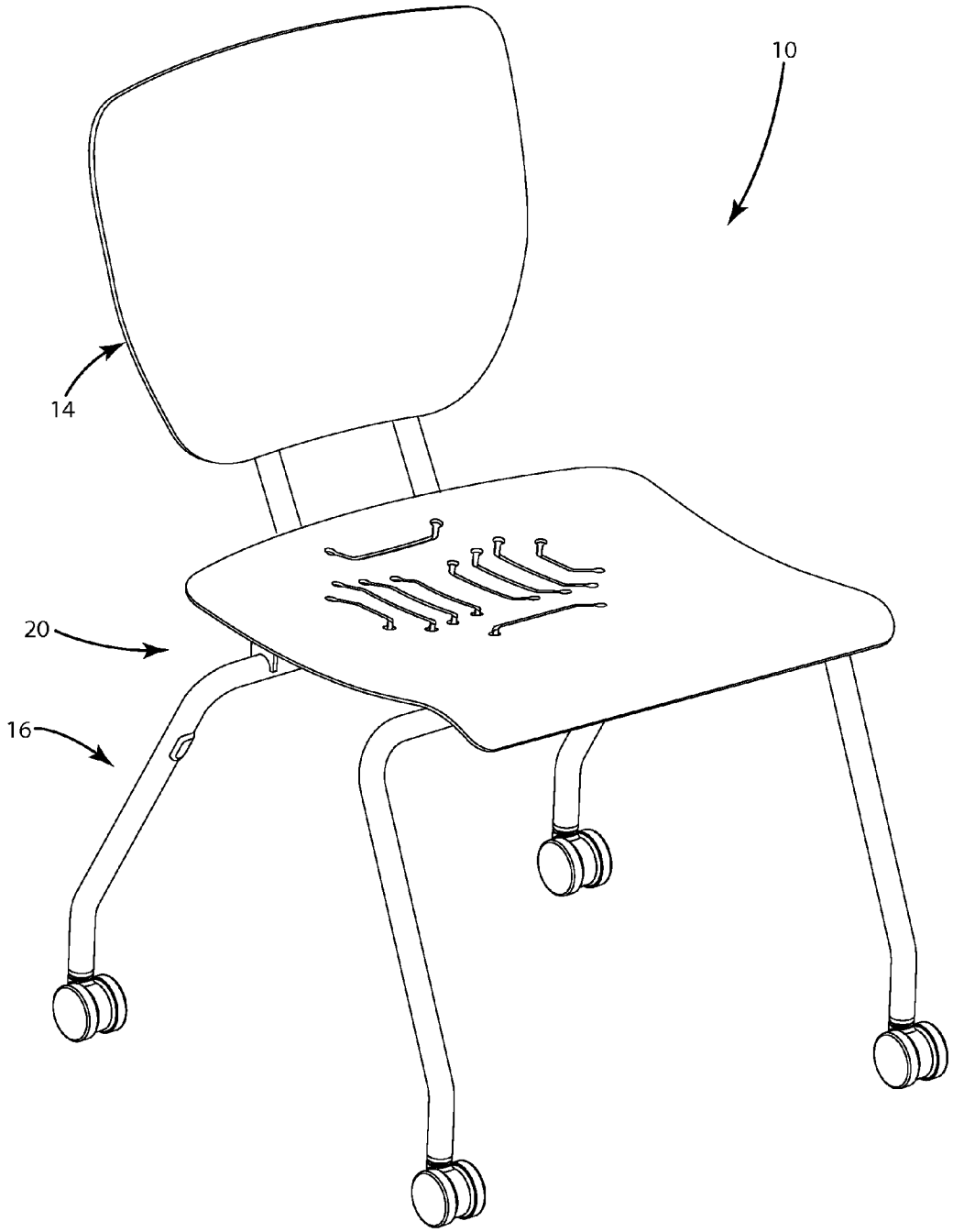
FIG. 1 is a perspective view of a seat according to one embodiment of the present invention.

A seat assembly 10 is shown in FIG. 1 and includes a seat 20 constructed in accordance with one embodiment of the present invention. Although FIG. 1 illustrates the seat 20 as part of a complete seat assembly 10 with a seat back 14 and support structure 16, this is only exemplary. The seat 20 may be generally used in connection with any structure intended to provide seated support.

Figure 2:
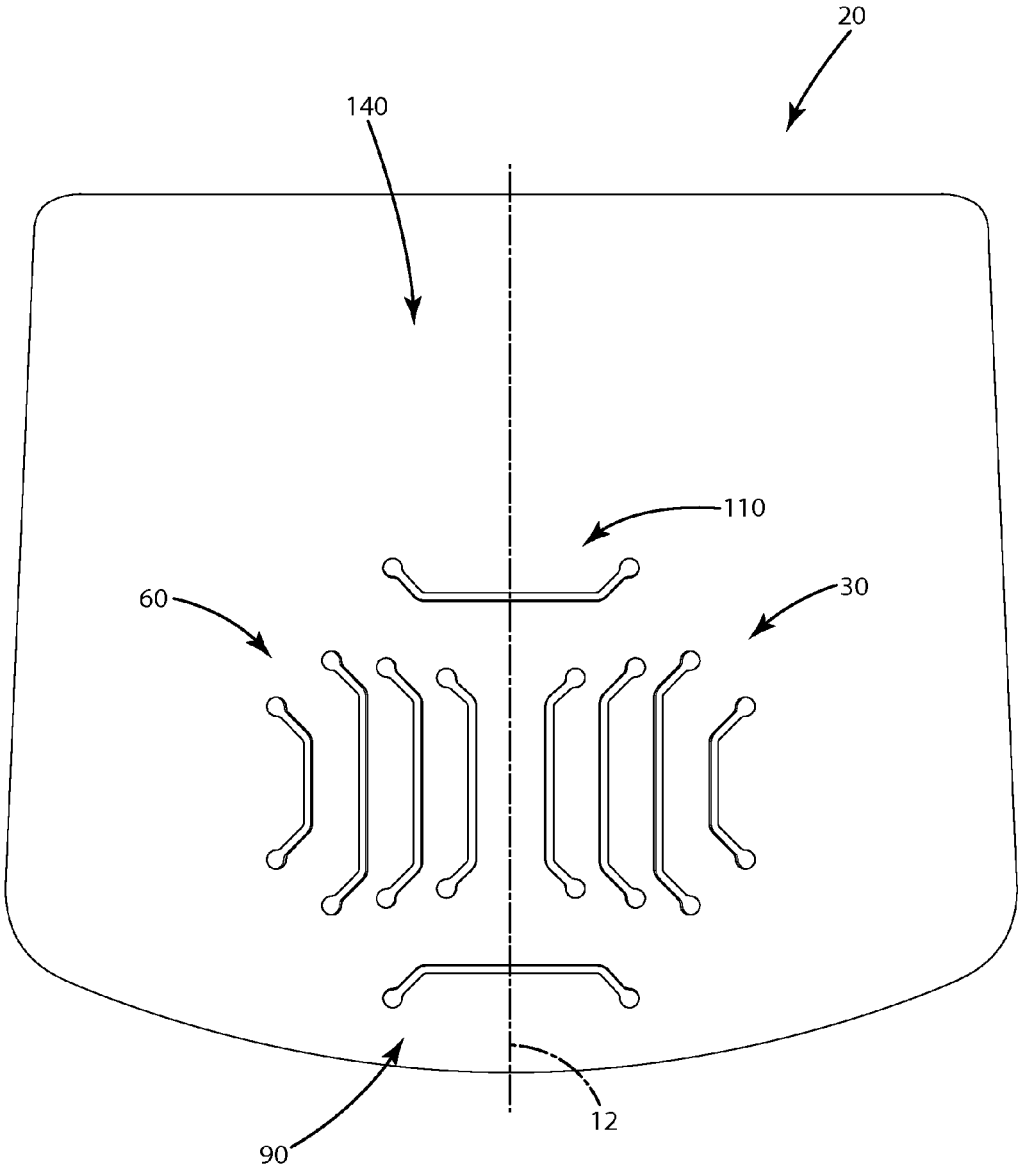
FIG. 2 is a top view of the seat from FIG. 1.

As shown in FIG. 2, the seat 20 generally includes a longitudinal axis 12 drawn from a front of the seat 20 to a rear of the seat 20 and generally dividing the seat 20 into two equal halves. As shown in FIG. 2, the seat 20 includes multiple high pressure regions. A first ischial region 30 is generally positioned below the right ischial (hip) bone of a user and is located on a first side of the longitudinal axis 12. A second ischial region 60 is generally positioned below the left ischial bone of a user and is located on a second side of the longitudinal axis 12. A tailbone region 90 is generally positioned below the tailbone of a user and is located rearward of the first and second ischial regions 30, 60. A thigh transitional region 110 is generally positioned between the upper thighs of a user and is located forward of the first and second ischial regions 30, 60. A center of the seat is located between the first ischial region 30, the second ischial region 60, the tailbone region 90, and the thigh transitional region 110. The first ischial region 30, second ischial region 60, tailbone region 90, and thigh transitional region 110 each include at least one slot specifically designed to provide a desired amount of deflection of the corresponding region of the seat 20 when a user sits on the seat 20. The slots may generally open outwardly, away from the center of the seat, and may be designed to allow a cantilevering of the areas adjacent to the slots to contour the seat based on a user's weight. The cantilevering effect and slot configuration was found to provide a substantially consistent support profile over a wide range of user weights. The slot configuration may also allow the seat to achieve the same or a similar magnitude and profile of flexing as is created by some foam materials.

II. Structure

Figure 3:
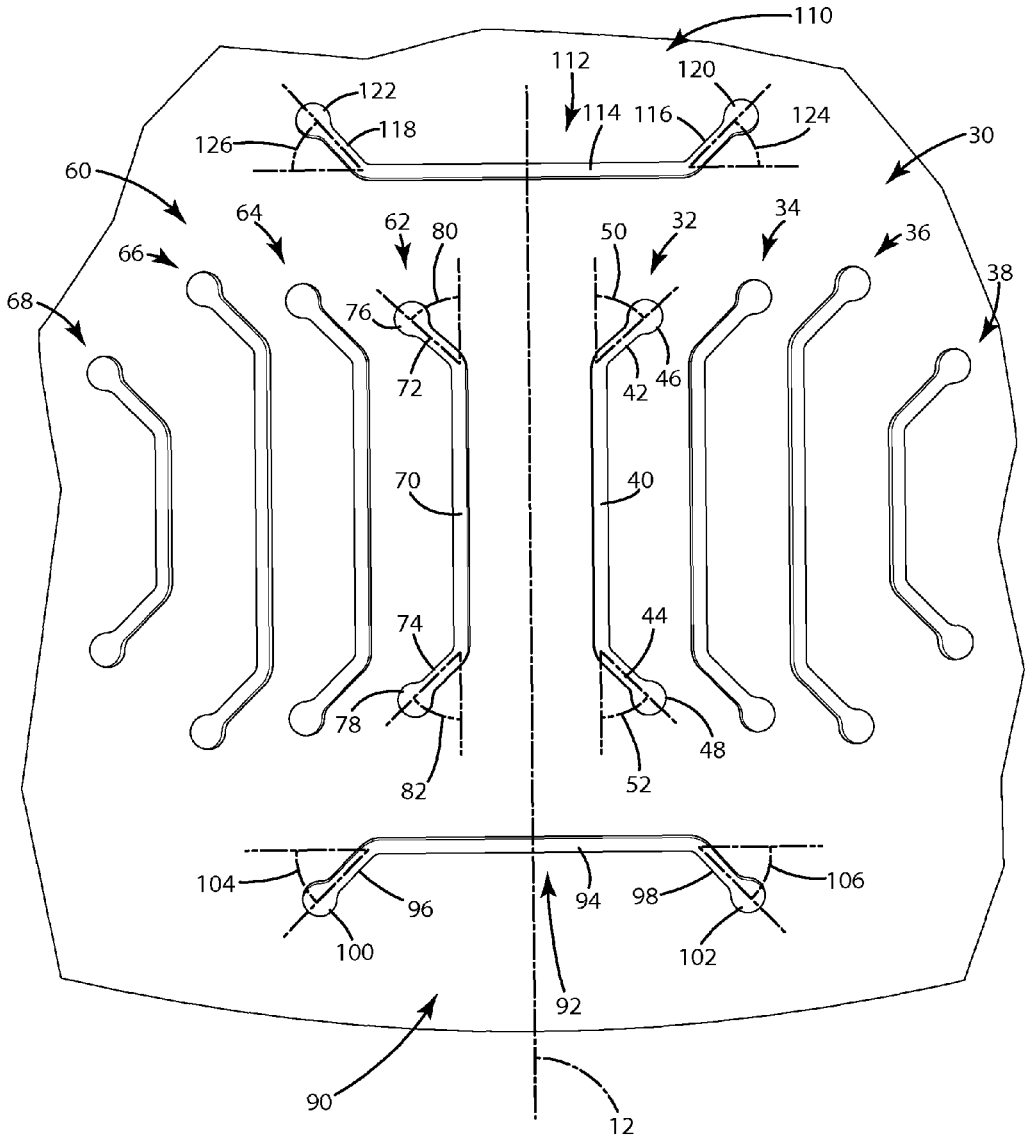
FIG. 3 is an enlarged top view of the seat from FIG. 1.
Figure 4:
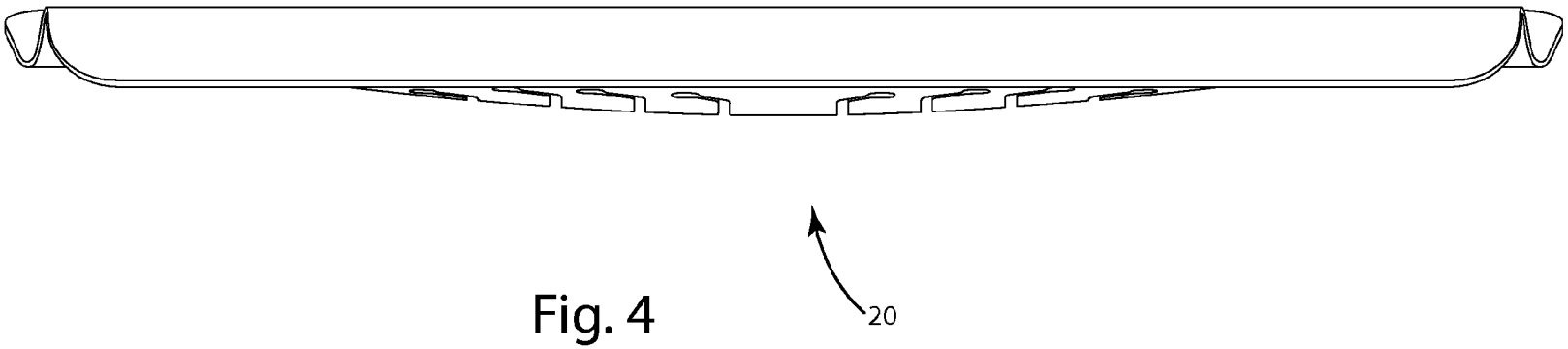
FIG. 4 is a front view of the seat from FIG. 1.
Figure 5:
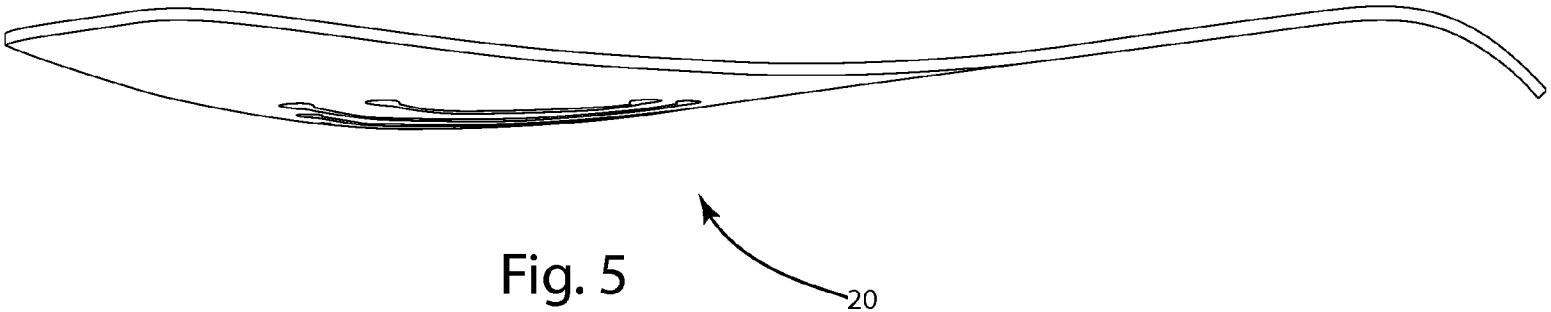
FIG. 5 is a side view of the seat from FIG. 1.

As shown in FIG. 3, the first ischial region 30 includes a plurality of first ischial slots 32-38 defined in the seat 20. The first ischial slots 32-38 may be defined partially or completely through the seat 20. As illustrated, the seat 20 may have four first ischial slots 32-38, although a greater or fewer number of slots may be used depending on the support desired. As illustrated in connection with first ischial slot 32, each of the first ischial slots 32-38 may include a central portion 40, a first distal portion 42 adjacent a first end of the central portion 40, and a second distal portion 44 adjacent a second end of the central portion 40. The central portion 40, first distal portion 42 and second distal portion 44 may be any suitable shape, including curved and substantially linear. An end portion 46, 48 may be defined adjacent and connect with the respective distal portions 42, 44. The end portion 46, 48 may be designed to relieve stress in the seat material surrounding the end portions 46, 48. Although illustrated as substantially circular, the end portions 46, 48 may have any suitable rounded shape, including an oval or an elongated oval. The distal portions 42, 44 may each form an angle 50, 52 relative to the central portion 40. The angles 50, 52 may be any suitable angle, and may be unequal or substantially equal. The distal portions 42, 44 may have any desired orientation with respect to one another, including being at an angle to one another and being substantially perpendicular to one another. The central portion 40 may extend at an angle to or substantially parallel to the longitudinal axis 12, and the distal portions 42, 44 may extend at an angle to or substantially parallel to the longitudinal axis 12. The central portions 40 and distal portions 42, 44 of each of the first ischial slots 32-38 may have any suitable configuration with respect to the other central portions 40 and distal portions 42, 44, including being substantially parallel to or at an angle to the central portions 40 and distal portions 42, 44 of each of the other first ischial slots 32-38. The relative sizes of the central portions 40 of the first ischial slots 32-38 may vary as desired. As illustrated, the central portion 40 of the first ischial slot 36 may be the longest, followed by the central portion 40 of the first ischial slot 34, the central portion 40 of the first ischial slot 32, and the central portion 40 of the first ischial slot 38. The relative sizes of the distal portions 42, 44 of the first ischial slots 32-38 may vary as desired. The distal portions 42, 44 may be substantially equal in length, or may have unequal lengths. As shown in FIG. 3, the central portions 40 may have a greater length than each of the distal portions 42, 44.

As shown in FIG. 3, the second ischial region 60 includes a plurality of second ischial slots 62-68 defined in the seat 20. The seat 20 may have four second ischial slots 62-68, although a greater or fewer number of slots may be used depending on the support desired. As illustrated in connection with the second ischial slot 62, each of the second ischial slots 62-68 may include a central portion 70, a first distal portion 72 adjacent a first end of the central portion 70, and a second distal portion 74 adjacent a second end of the central portion 70. The second ischial slots 62-68 may generally have the same configurations as described above in connection with the first ischial slots 32, and those configurations will not be redescribed here. The second ischial slots 62-68 may have any suitable configuration, including generally being a minor image of the first ischial slots 32-38. The central portions 70 of each of the second ischial slots 62-68 may be oriented substantially parallel to or at an angle to the central portions 40 of each of the first ischial slots 32-38. The first distal portions 72 of the second ischial slots 62-68 may be oriented substantially parallel to or at an angle to the second distal portions 44 of the first ischial slots 32-38, and the second distal portions 74 of the second ischial slots 62-68 may be oriented substantially parallel to or at an angle to the first distal portions 42 of the first ischial slots 32-38.

A tailbone slot 92 may be defined within the seat 20 in the tailbone region 90. The tailbone slot 92 may be defined partially or completely through the seat 20. As illustrated, the seat 20 may have one tailbone slot 92, although a greater or fewer number of slots may be used depending on the support desired. The tailbone slot 92 may include a central portion 94, a first distal portion 96 adjacent a first end of the central portion 94, and a second distal portion 98 adjacent a second end of the central portion 94. The central portion 94, first distal portion 96 and second distal portion 98 may be any suitable shape, including curved and substantially linear. An end portion 100, 102 may be defined adjacent and connect with the respective distal portions 96, 98. The end portion 100, 102 may be designed to relieve stress in the seat material surrounding the end portions 100, 102. Although illustrated as substantially circular, the end portions 100, 102 may have any suitable rounded shape, including an oval or an elongated oval. The distal portions 96, 98 may each form an angle 104, 106 relative to the central portion 94. The angles 104, 106 may be any suitable angle, and may be unequal or substantially equal. Optionally, the angles 104, 106 may be unequal to or substantially equal to one or more of the angles 50, 52, 80, 82 formed by the first ischial slots 32-38 and the second ischial slots 62-68. Further optionally, the angles 104, 106 may be unequal to or substantially equal to all of the angles 50, 52, 80, 82 formed by the first ischial slots 32-38 and the second ischial slots 62-68. The distal portions 96, 98 may have any desired orientation with respect to one another, including being at an angle to one another and being substantially perpendicular to one another. The distal portions 96, 98 may be substantially equal in length, or may have unequal lengths. Further, the distal portions 96, 98 may have a length unequal to or substantially equal to one or more of the first ischial distal portions 42, 44 and second ischial distal portions 72, 74. Optionally, the distal portions 96, 98 may have a length unequal to or substantially equal to all of the first ischial distal portions 42, 44 and second ischial distal portions 72, 74. The central portion 94 may extend in any suitable direction, including at an angle to or substantially perpendicular to the longitudinal axis 12. The central portion 94 may be any suitable length, and may have a greater length than each of the distal portions 96, 98. Optionally, the longitudinal axis 12 may intersect the central portion 94, and further optionally, the longitudinal axis 12 may bisect the central portion 94. The distal portions 96, 98 may extend at an angle to or substantially parallel to the longitudinal axis 12.

The tailbone slot 92 may have any suitable positioning relationship relative to the first ischial slots 32-38 and the second ischial slots 62-68 to provide desired support characteristics. The tailbone slot central portion 94 may be oriented at any suitable angle, including being substantially perpendicular to one or more of the central portions 40 of the first ischial slots 32-38 and the central portions 70 of the second ischial slots 62-68. Optionally, the tailbone slot central portion 94 may be substantially perpendicular to all of the central portions 40 of the first ischial slots 32-38 and the central portions 70 of the second ischial slots 62-68. The tailbone slot first distal portion 96 may be at an angle to or substantially parallel to one or more of the first distal portions 42 of the first ischial slots 32-38 and the second distal portions 74 of the second ischial slots 62-68. Optionally, the tailbone slot first distal portion 96 may be at an angle to or substantially parallel to all of the first distal portions 42 of the first ischial slots 32-38 and the second distal portions 74 of the second ischial slots 62-68. The tailbone slot second distal portion 98 may be at an angle to or substantially parallel to one or more of the second distal portions 44 of the first ischial slots 32-38 and the first distal portions 72 of the second ischial slots 62-68. Optionally, the tailbone slot second distal portion 98 may be at an angle to or substantially parallel to all of the second distal portions 44 of the first ischial slots 32-38 and the first distal portions 72 of the second ischial slots 62-68.

A thigh transitional slot 112 may be defined within the seat 20 in the thigh transitional region 110. The thigh transitional slot 112 may be defined partially or completely through the seat 20. As illustrated, the seat 20 may have one thigh transitional slot 112, although a greater or fewer number of slots may be used depending on the support desired. The thigh transitional slot 112 may include a central portion 114, a first distal portion 116 adjacent a first end of the central portion 114, and a second distal portion 118 adjacent a second end of the central portion 114. The central portion 114, first distal portion 116 and second distal portion 118 may be any suitable shape, including curved and substantially linear. An end portion 120, 122 may be defined adjacent and connect with the respective distal portions 116, 118. The end portion 120, 122 may be designed to relieve stress in the seat material surrounding the end portions 120, 122. Although illustrated as substantially circular, the end portions 120, 122 may have any suitable rounded shape, including an oval or an elongated oval. The distal portions 116, 118 may each form an angle 124, 126 relative to the central portion 114. The angles 124, 126 may be any suitable angle, and may be unequal or substantially equal. Optionally, the angles 124, 126 may be unequal to or substantially equal to one or more of the angles 50, 52, 80, 82, 104, 106 formed by the first ischial slots 32-38, the second ischial slots 62-68 and the tailbone slot 92. Further optionally, the angles 124, 126 may be unequal to or substantially equal to all of the angles 50, 52, 80, 82, 104, 106 formed by the first ischial slots 32-38, the second ischial slots 62-68 and the tailbone slot 92. The distal portions 116, 118 may have any desired orientation with respect to one another, including being at an angle to one another and being substantially perpendicular to one another. The distal portions 116, 118 may be substantially equal in length, or may have unequal lengths. Further, the distal portions 116, 118 may have a length unequal to or substantially equal to one or more of the first ischial distal portions 42, 44, the second ischial distal portions 72, 74, and the tailbone slot distal portions 96, 98. Optionally, the distal portions 116, 118 may have a length unequal to or substantially equal to all of the first ischial distal portions 42, 44, the second ischial distal portions 72, 74, and the tailbone slot distal portions 96, 98. The central portion 114 may extend in any suitable direction, including at an angle to or substantially perpendicular to the longitudinal axis 12, as illustrated. The central portion 114 may be any suitable length, and may have a greater length than each of the distal portions 116, 118. Optionally, the longitudinal axis 12 may intersect the central portion 114, and further optionally, the longitudinal axis 12 may bisect the central portion 114. The distal portions 116, 118 may extend at an angle to or substantially parallel to the longitudinal axis 12.

The thigh transitional slot 112 may have any suitable positioning relationship relative to the first ischial slots 32-38, the second ischial slots 62-68 and the tailbone slot 92 to provide desired support characteristics. The thigh transitional slot central portion 114 may be oriented at any suitable angle, including being substantially perpendicular to one or more of the central portions 40 of the first ischial slots 32-38 and the central portions 70 of the second ischial slots 62-68. Optionally, the thigh transitional slot central portion 114 may be substantially perpendicular to all of the central portions 40 of the first ischial slots 32-38 and the central portions 70 of the second ischial slots 62-68. The thigh transitional slot central portion 114 may be at an angle to or substantially parallel to the tailbone slot central portion 94. The thigh transitional slot first distal portion 116 may be at an angle to or substantially parallel to one or more of the first distal portions 42 of the first ischial slots 32-38, the second distal portions 74 of the second ischial slots 62-68, and the tailbone slot first distal portion 96. Optionally, the thigh transitional slot first distal portion 116 may be at an angle to or substantially parallel to all of the first distal portions 42 of the first ischial slots 32-38, the second distal portions 74 of the second ischial slots 62-68, and the tailbone slot first distal portion 96. The thigh transitional slot second distal portion 118 may be at an angle to or substantially parallel to one or more of the second distal portions 44 of the first ischial slots 32-38, the first distal portions 72 of the second ischial slots 62-68, and the tailbone slot second distal portion 98. Optionally, the thigh transitional slot second distal portion 118 may be at an angle to or substantially parallel to all of the second distal portions 44 of the first ischial slots 32-38, the first distal portions 72 of the second ischial slots 62-68, and the tailbone slot second distal portion 98.

In use, the slots 32-38, 62-68, 92, 112 may be designed to allow a cantilevering of the areas adjacent to the slots 32-38, 62-68, 92, 112 to contour the seat based on a user's weight. The slot configuration may approximate the support magnitude and profile provided by some foam constructions. As illustrated, the slots may generally be curved or open outward relative to a center of the seat, which may allow portions of the seat positioned adjacent and outward of each slot to cantilever and deflect downward relative to the seat surface and outward relative to the center of the seat. In this manner, the areas of seat 20 adjacent the slots 32-38, 62-68, 92, 112 may dynamically flex to support a user while accommodating the dynamic movements of the user. The degree or magnitude of flex may be based on the weight of the user. The seat 20 may relieve the high pressure otherwise present in the first ischial region 30, the second ischial region 60, the tailbone region 90 and the thigh transitional region 110.

Figure 6:
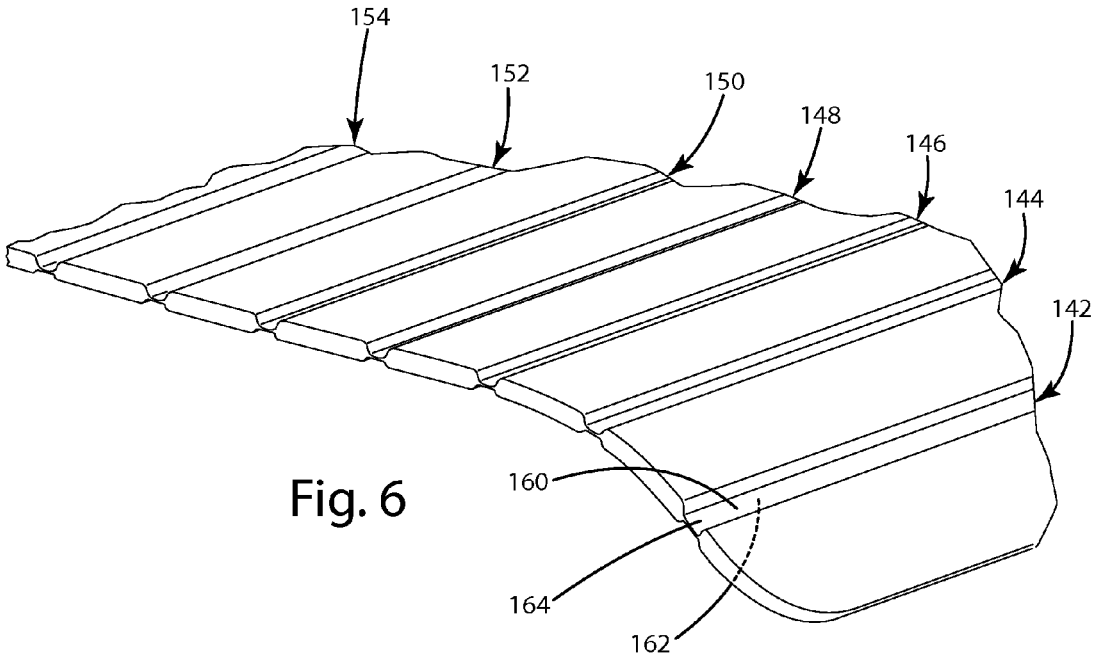
FIG. 6 is an enlarged perspective view of a seat according to another embodiment of the present invention.

As shown in FIG. 2, a thigh region 140 may be generally positioned at the front of the seat 20 in front of the thigh transitional region 110. The thigh region 140 may be generally positioned below the lower thighs of a user. As shown in the embodiment of FIG. 6, the thigh region 140 may include one or more grooves 142-154 to facilitate flexing and curling of the front of seat 20. The flexing movement of the front of seat 20 can provide a desired amount of support for a user's thighs while the user is sitting in the seat 20. For example, while a user remains stationary in a seated position with regard to the first ischial region 30, second ischial region 60, tailbone region 90 and thigh transitional region 110, the thigh region 140 may be extended forward or curled rearward under the seat 20 to provide a desired level of support for the user's thighs. This may be useful because a user may not be able to move forward and rearward to adjust their thigh support, while at the same time remaining in a proper support position with respect to the slots in seat 20. The grooves 142-154 may be defined partially through the seat 20. Optionally, the grooves 142-154 may be defined completely through the seat at certain distances along the lengths of the grooves 142-154. As shown in FIG. 6, each of the grooves 142-154 may include a top channel 160 defined in a top surface of the seat 20, and a corresponding bottom channel 162 defined in a bottom surface of the seat 20. Each groove 142-154 may include a thinned section 164 to connect the portions of the seat 20 adjacent the groove 142-154. The grooves 142-154 may be positioned in any location suitable to provide desired support characteristics. As shown in FIG. 2, the grooves 142-154 may extend from one side of the seat 20 to an opposite side of the seat 20, and may be oriented substantially parallel to one another. Optionally, the grooves 142-154 may be oriented substantially perpendicular to one or more of the longitudinal axis 12, the central portions 40 of the first ischial slots 32-38, and the central portions 70 of the second ischial slots 62-68. Further optionally, the grooves 142-154 may be oriented substantially perpendicular to all of the longitudinal axis 12, the central portions 40 of the first ischial slots 32-38, and the central portions 70 of the second ischial slots 62-68. Still further optionally, the grooves 142-154 may be oriented substantially parallel to the tailbone slot central portion 94 and the thigh transitional slot central portion 114. A greater or fewer number of grooves 142-154 may be used, depending on the desired support characteristics. Optionally, the grooves 142-154 may be eliminated, depending on the desired support characteristics.

The seat 20 may be supported using any suitable mechanism to provide desired support characteristics. The seat 20 may be supported at an outer edge, to allow the interior portions of the seat 20 to be free to flex in response to a user's weight. Optionally, the seat may be supported by dynamic systems to vary the pressure and contour of the seat. In some embodiments, the interior portions of the seat may be supported using mechanical, pneumatic or hydraulic systems to flex, or control the amount of flexing of selected areas of the seat 20. Further optionally, a system may be used to flex, or control the amount of flexing of the flexible thigh region 140. Each of the above systems may be equipped with sensors for determining the weight magnitude and distribution over the seat 20, and may include programming to control movement of the seat 20 according to the weight magnitude and distribution.

III. Manufacture

A seat 20 according to one embodiment of the present invention may be made of any suitable material, included plastics, copolymers and composites such as but not limited to BASF Ultraform and Sabic Innovative Plastics Xenoy IQ. The material may have several beneficial characteristics, such as a high elongation prior to yield (>6%), a high resiliency, a resistance to creep over time and a high toughness (>10,000 psi tensile strength at yield and 100,000-275,000 psi tensile modulus). The seat 20 may be made of one consistent material, or may be made with different regions having different materials to provide desired support characteristics. The seat 20 may be made using any suitable process, including injection molding and compression molding. In embodiments with two or more different materials, a two-stage injection molding process, or any other suitable manufacturing process, may be used.

The support frame 16 may be made of any suitable material, including plastics, metals and composites. The support frame 16 may be separately formed and attached to the seat 20 using any suitable fastening means, including a friction fit, adhesives, and fasteners. Optionally, if the support frame 16 is made of plastic, the support frame may be integrally formed with the seat 20. Further optionally, the support frame 16 and seat 20 may be formed during a single molding process.

The seat back 14 may be made of any suitable material, including plastics, metals and composites. The seat back 14 may be separately formed and attached to the seat 20 using the fastening means above, or may be integrally formed with the seat 20 as described above in connection with the support frame 16.

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Features of various embodiments may be used in combination with features from other embodiments. Directional terms, such as "vertical," "horizontal," "top," "bottom," "front," "rear," "upper," "lower," "inner," "inwardly," "outer," "outwardly," "forward," and "rearward" are used to assist in describing the invention based on the orientation of the embodiments shown in the illustrations. The use of directional terms should not be interpreted to limit the invention to any specific orientation (s). Any reference to claim elements in the singular, for example, using the articles "a," "an," "the" or "said," is not to be construed as limiting the element to the singular.

The embodiments of the invention in which an exclusive property or privilege is claimed are defined as follows:

1. A seat comprising:

a longitudinal axis generally extending from a front of the seat to a rear of the seat and generally dividing the seat into two equal halves;

a first ischial region located on a first side of the longitudinal axis, a second ischial region located on a second side of the longitudinal axis, a tailbone region located rearward of the first and second ischial regions, a thigh transitional region located forward of the first and second ischial regions;

a center of the seat located between the first ischial region, the second ischial region, the tailbone region, and the thigh transitional region;

a plurality of first ischial slots defined within the seat in the first ischial region;

a plurality of second ischial slots defined within the seat in the second ischial region;

a tailbone slot defined within the seat in the tailbone region; and a thigh transitional slot defined within the seat in the thigh transitional region, wherein each slot extends through the seat;

wherein at least a portion of each of the first ischial slots extends substantially parallel to the longitudinal axis, wherein at least a portion of each of the second ischial slots extends substantially parallel to the longitudinal axis, wherein at least a portion of the tailbone slot extends at an angle relative to the longitudinal axis, wherein at least a portion of the thigh transitional slot extends at an angle relative to the longitudinal axis; and wherein the central portions and the distal portions are substantially linear, and wherein each of the distal portions are oriented at an angle with respect to each of the corresponding central portions, wherein the distal portions of the first and second ischial slots are angled away from the longitudinal axis, and the distal portions of the tailbone slot are angled toward the rear of the seat and the distal portions of the thigh transitional slot are angled toward the front of the seat.

2. The seat of claim 1 wherein the angle between each first distal portion and each corresponding central portion is substantially equal to an angle between each corresponding second distal portion and each corresponding central portion.

3. The seat of claim 1 wherein the tailbone slot central portion and the thigh transitional slot central portion are bisected by the longitudinal axis.

4. The seat of claim 3 wherein the tailbone slot central portion is substantially parallel to the thigh transitional slot central portion.

5. The seat of claim 4 wherein the tailbone slot central portion and the thigh transitional slot central portion are substantially perpendicular to the longitudinal axis.

6. The seat of claim 5 wherein the tailbone slot first distal portion is substantially parallel to the thigh transitional slot first distal portion, and the tailbone slot second distal portion is substantially parallel to the thigh transitional slot second distal portion.

7. The seat of claim 5 wherein the first ischial slot central portions are substantially parallel to each other.

8. The seat of claim 7 wherein the second ischial slot central portions are substantially parallel to each other.

9. The seat of claim 8 wherein the first ischial slot central portions are substantially parallel to the second ischial slot central portions.

10. The seat of claim 9 wherein the first ischial slot central portions and the second ischial slot central portions are substantially parallel to the longitudinal axis.

11. The seat of claim 10 wherein the first ischial slot first distal portions are substantially parallel to each other, the first ischial slot second distal portions are substantially parallel to each other, the second ischial slot first distal portions are substantially parallel to each other, and the second ischial slot second distal portions are substantially parallel to each other.

12. The seat of claim 11 wherein the first ischial slot first distal portions are substantially parallel to the second ischial slot second distal portions, and the first ischial slot second distal portions are substantially parallel to the second ischial slot first distal portions.

13. The seat of claim 12 wherein the tailbone slot first distal portion and the thigh transitional slot first distal portion are substantially parallel to the first ischial slot first distal portions and the second ischial slot second distal portions.

14. The seat of claim 13 wherein the tailbone slot second distal portion and the thigh transitional slot second distal portion are substantially parallel to the first ischial slot second distal portions and the second ischial slot first distal portions.

15. The seat of claim 1 including a thigh region forward of the thigh transitional region, a plurality of flex grooves defined in the thigh region to facilitate curling of the thigh region.

16. The seat of claim 15 wherein the flex grooves are substantially linear and extend substantially parallel to each other.

17. The seat of claim 16 wherein each of the flex grooves extends substantially perpendicular to the longitudinal axis.

* * * * *